US007080954B2

(12) United States Patent
Monneret et al.

(10) Patent No.: US 7,080,954 B2
(45) Date of Patent: Jul. 25, 2006

(54) READY-TO-INSTALL ROAD BUILDING APPARATUS AND CORRESPONDING INSTALLATION METHOD

(75) Inventors: Jean-Jacques Monneret, Villeurbanne (FR); Philippe Tievant, Parmain (FR)

(73) Assignee: Norinco, Saint Crepin Ibouvillers (FR)

( * ) Notice: Subject to any disclaimer, the term of this patent is extended or adjusted under 35 U.S.C. 154(b) by 107 days.

(21) Appl. No.: 10/474,771

(22) PCT Filed: Apr. 24, 2002

(86) PCT No.: PCT/FR02/01414

§ 371 (c)(1),
(2), (4) Date: Mar. 23, 2004

(87) PCT Pub. No.: WO02/086247

PCT Pub. Date: Oct. 31, 2002

(65) Prior Publication Data

US 2004/0156678 A1 Aug. 12, 2004

(30) Foreign Application Priority Data

Apr. 24, 2001 (FR) ..... 01 05502

(51) Int. Cl.
*E02D 29/14* (2006.01)

(52) U.S. Cl. ..... 404/25; 52/19

(58) Field of Classification Search ..... 404/25, 404/26; 52/19, 20

See application file for complete search history.

(56) References Cited

U.S. PATENT DOCUMENTS

| | | | | |
|---|---|---|---|---|
| 1,738,893 | A * | 12/1929 | Grady | 220/301 |
| 2,363,567 | A * | 11/1944 | Blakeman | 292/6 |
| 3,914,911 | A * | 10/1975 | Paasch | 52/180 |
| 4,038,789 | A * | 8/1977 | Axgarde et al. | 52/20 |
| 4,917,531 | A * | 4/1990 | McGinnis | 404/26 |
| 4,964,755 | A * | 10/1990 | Lewis et al. | 404/25 |
| 5,071,177 | A * | 12/1991 | Spiess et al. | 292/91 |
| 5,340,232 | A * | 8/1994 | Spiess et al. | 404/25 |
| 5,555,998 | A * | 9/1996 | Coppola | 220/484 |
| 5,582,720 | A * | 12/1996 | Deming | 210/164 |
| 5,941,025 | A * | 8/1999 | Chang | 52/20 |
| 5,979,117 | A * | 11/1999 | Fuller | 52/19 |
| 6,371,687 | B1 * | 4/2002 | Heintz et al. | 404/26 |
| 6,371,688 | B1 * | 4/2002 | Yang et al. | 404/26 |
| 6,550,294 | B1 * | 4/2003 | Garguilo | 701/168 |

FOREIGN PATENT DOCUMENTS

| | | |
|---|---|---|
| DE | 93 13 697 | 10/1993 |
| DE | 296 97 127 | 8/1997 |

* cited by examiner

*Primary Examiner*—Raymond W. Addie
(74) *Attorney, Agent, or Firm*—Leydig, Voit & Mayer, Ltd.

(57) ABSTRACT

An apparatus for covering a ditch includes a cover and girders having rabbets with projecting edges and flat-lying edges, the cover being placed on the rabbets. The apparatus has, before it is set up, a configuration for installation including one or several bars passing through lower webs of the girders and fixed to the girders and to the cover to maintain their final configuration, and level adjusting screws in edges of the girders defining a polygon providing stable support.

15 Claims, 5 Drawing Sheets

K.

READY-TO-INSTALL ROAD BUILDING APPARATUS AND CORRESPONDING INSTALLATION METHOD

FIELD OF THE INVENTION

The invention generally concerns road equipment and its installation.

More precisely, according to a first of its aspects, the invention concerns road equipment which, after having been put into service, is intended to cover a ditch and which has first and second main beams and a cover that has first and second parallel and opposite edges, the first and second main beams having respective first and second rabbets, respective first and second upright edges bordering the respective rabbets on the outside, and first and second horizontal flanges bordering the respective first and second upright edges on the outside, the main beams and the cover, in service, assuming definitive relative positions in which the cover is applied, by its first and second opposite edges, on the respective rabbets of the main beams arranged parallel to one another, and the main beams, in service, being buried in a layer of covering material extending over the flanges until its height hides the upright edges.

BACKGROUND

Road equipment of this type, although widely used for numerous years, poses considerable installation problems.

In effect, after having erected the parallel walls that delimit the ditch, it is necessary first to install side boards at regular intervals on the facing edges of the walls.

Then, quick-setting concrete pads are poured on each of the walls at the site of these side boards, so as to be able to level the upper surface of the walls.

After drying, the main beams are placed on the pads, and the cover is placed the main beams.

Each wall is then raised by another layer of concrete, so as to bury the base of the main beams.

A final layer of concrete or a layer of asphalt is then poured around the main beams, outside of the cover.

After drying, the cover is withdrawn, and the side boards and their holding elements are extracted.

Under these conditions, the installation of the known road elements is time-consuming and expensive.

SUMMARY OF THE INVENTION

The invention, which is situated in this context, aims to propose a road element whose installation, on the contrary, is rapid and simple.

For this purpose, the apparatus of the invention, includes main beams having respective first and second lower webs extending below the respective first and second rabbets, and which are at least drilled with respective first and second holes. This apparatus, before having been put in service, has an installation configuration in which it has at least a first bar passing through the respective first and second holes, which is attached to the first and second main beams and maintains the latter and a cover in fixed positions, and has at least three level-adjustment screws screwed into the flanges of the main beams and defining, for this apparatus configuration, a support polygon.

Preferably, this equipment has, in an installation configuration, a second bar, distant from the first bar, which passes through third and fourth holes respectively drilled in the first and second lower webs, which is attached to the first and second main beams, and which maintains the latter and the cover in fixed relative positions.

Each bar has, for example, first and second ends by which it is respectively attached to the first and second flanges by respective first and second attachment screws.

The flange and the rabbet of each main beam can be coplanar.

The road equipment of the invention can have a first pair of level-adjustment screws screwed in respective ends of the first flange, and a second pair of level-adjustment screws screwed in respective ends of the second flange.

For each attachment or adjustment screw engaged in a hole of a flange, a threaded sleeve can be inserted between the screw and the hole that receives it.

For each bar, this equipment can also include a holding bolt engaged in an opening of the cover and in a hole in this bar.

The equipment of the invention can moreover have carriers straddling the upright edge of each main beam and inserted between this main beam and the cover.

According to a second aspect, the invention relates to a process for installation of the apparatus over a cavity, in particular, a ditch delimited between first and second parallel walls. The process includes putting down the first and second main beams of the apparatus in an installation configuration on the first and second walls, the lower webs being inserted with slight play between the walls, manipulating the leveling screws to immobilize the cover at a predetermined level with respect to the walls, and depositing, on both sides of the main beams, a layer of covering material which covers the walls up to the lower webs, burying the leveling screws, and covering the flanges of the main beams until the material hides the upright edges.

This installation process itself advantageously includes, possibly after setting of the layer of covering material, detaching the cover from each bar and sawing off each bar in the vicinity of each lower web.

BRIEF DESCRIPTION OF DRAWINGS FIGURES

Other characteristics and advantages of the invention will emerge clearly from the description given for it in the following, in an indicative and nonlimiting way with reference to the appended drawings in which.

Figure 3:
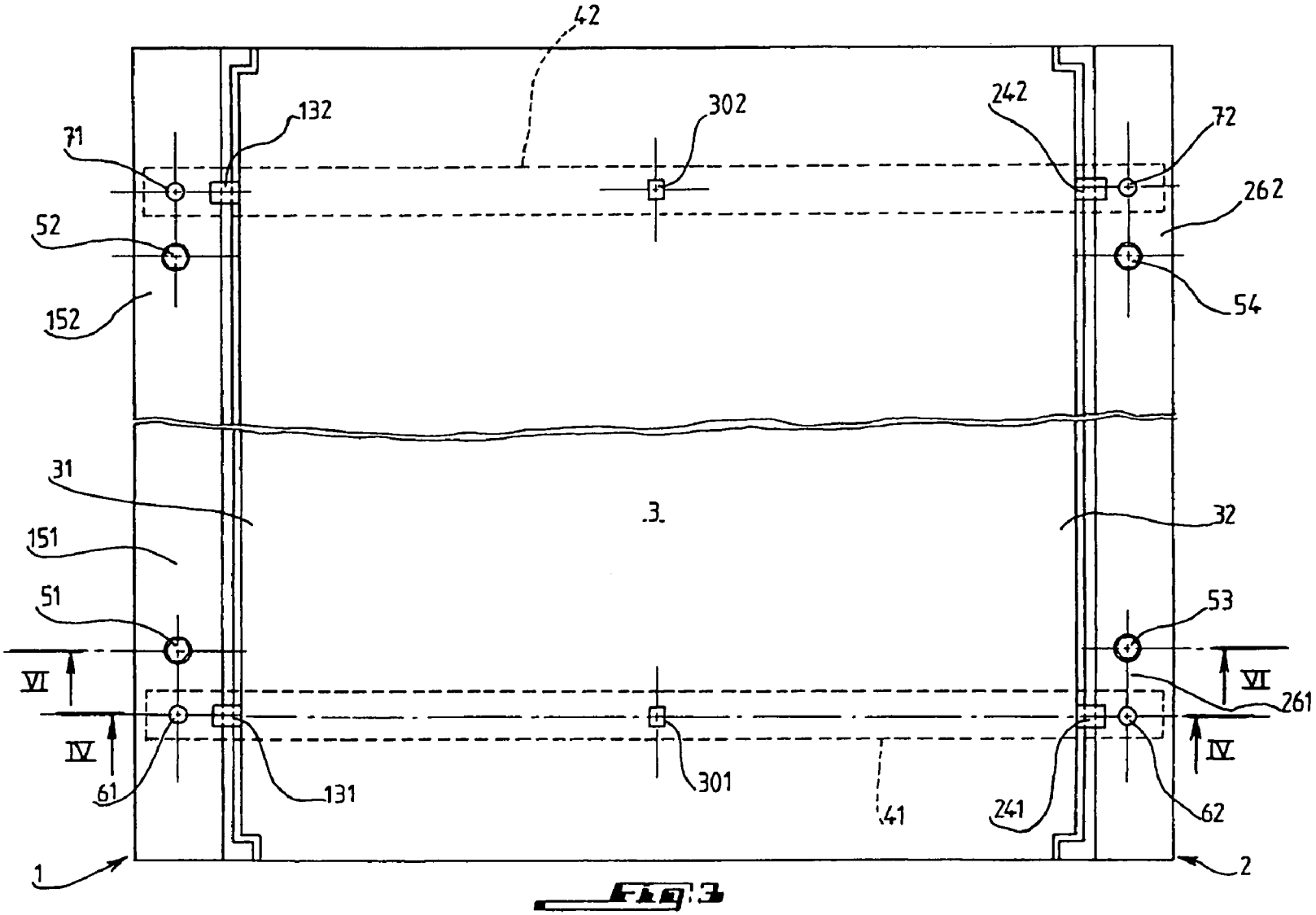
FIG. 3 is a plan view, on a larger scale than that of FIG. 2, of a device according to the invention.
Figure 5:
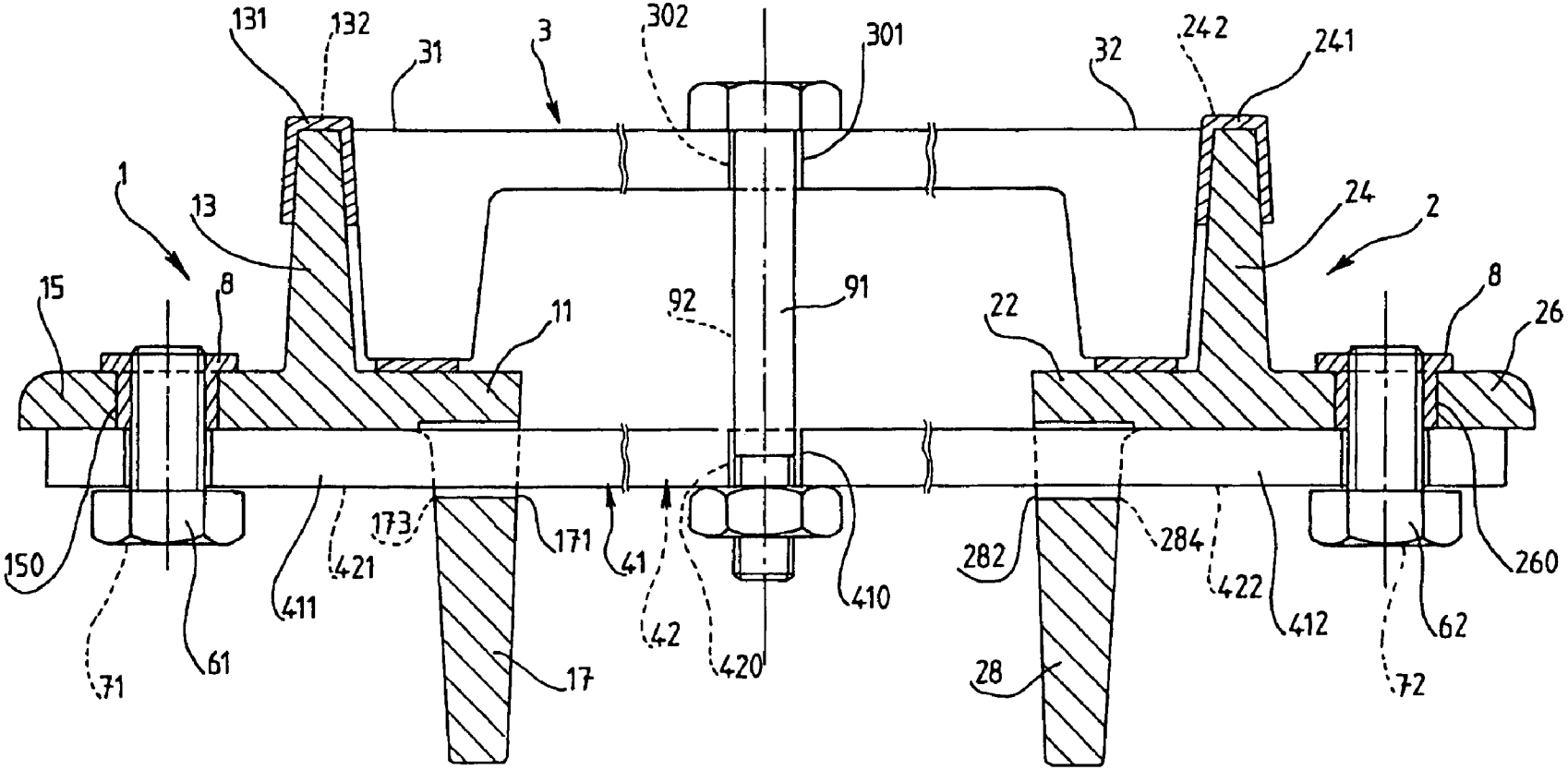
Figure 6:
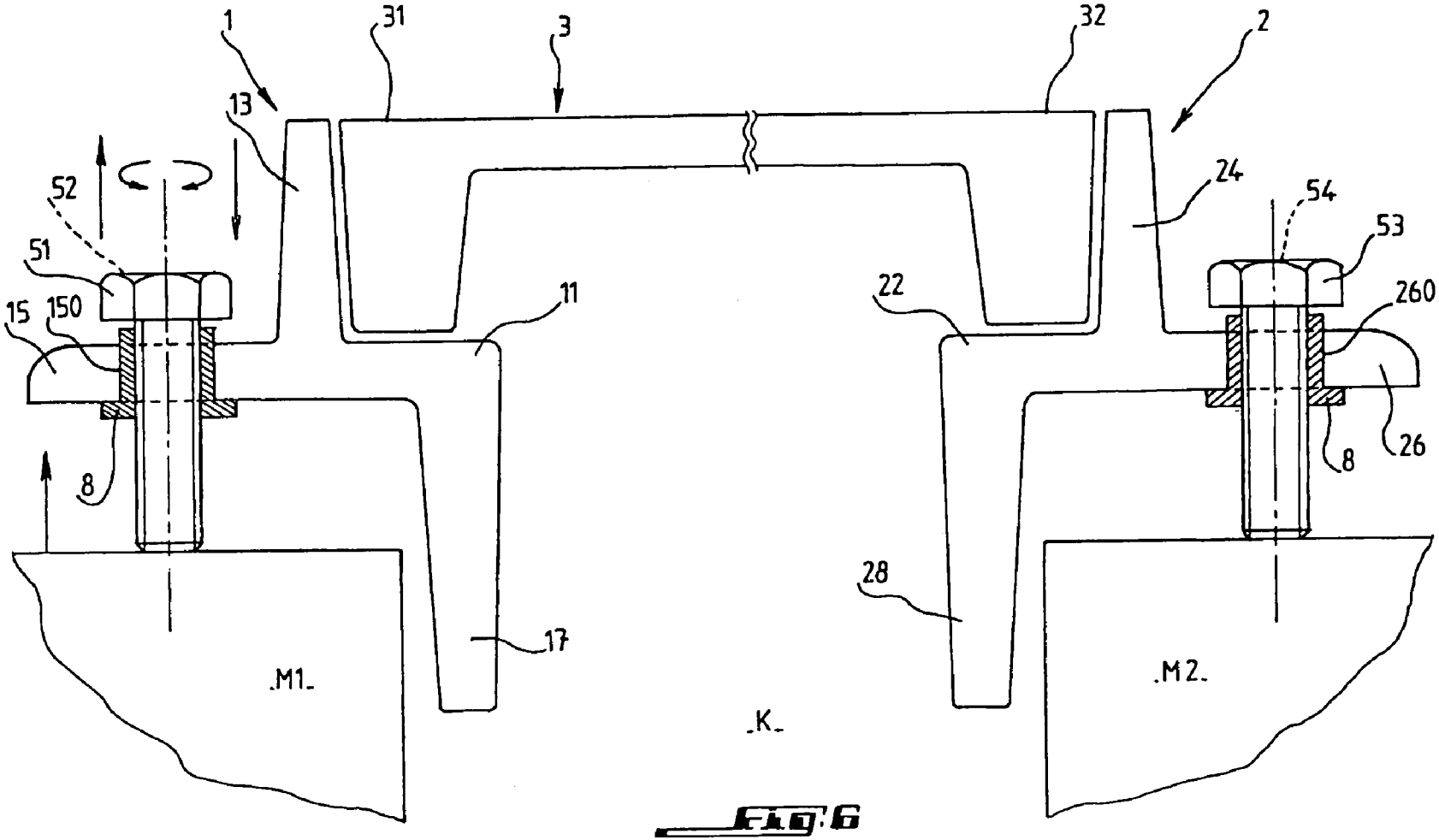

FIG. 5 is a view in vertical and transverse section of the device illustrated in FIG. 3, observed exclusively in the plane passing through arrows IV—IV of FIG. 3, the dotted lines pointing to background elements that are hidden by visible homologous elements to which the solid lines point; and FIG. 6 is a view in vertical and transverse section of the device illustrated in FIG. 3, observed exclusively in the plane passing through arrows VI—VI of FIG. 3, the dotted lines pointing to background elements which are hidden by visible homologous elements to which the solid lines point.

DETAILED DESCRIPTION

The invention relates to road apparatus which, after having been put in service, is intended to cover ditch K (FIG. 1), this equipment having two main beams 1 and 2, and cover 3 placed on the main beams by its parallel and opposite edges 31 and 32.

Each of main beams 1 and 2 (FIGS. 1, 4 and 5) has a rabbet such as 11 and 22, an upright edge such as 13 and 24 bordering the rabbet on the outside, and a horizontal flange such as 15 and 26 bordering the corresponding upright edge, 13 and 24, on the outside.

Figure 1:
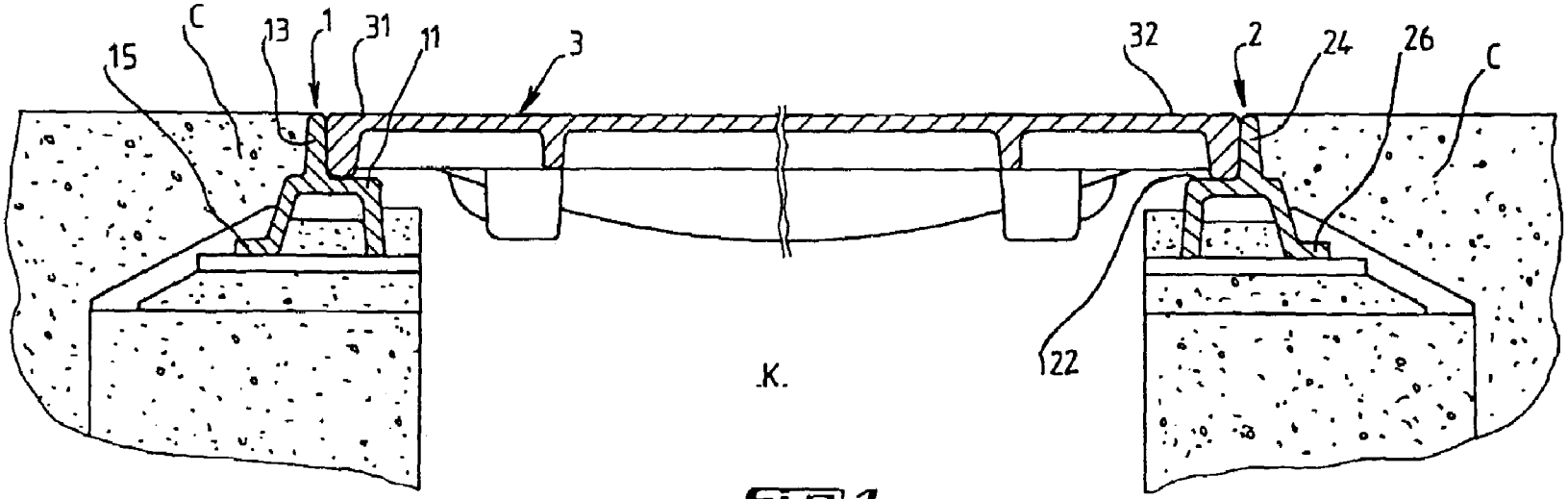
FIG. 1 is a view in partial cross section of a known device, represented after installation.
Figure 2:
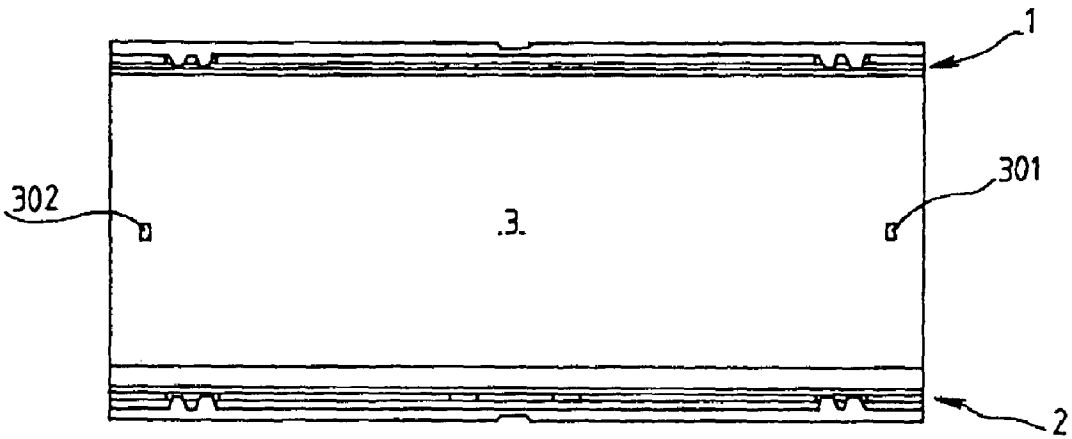
FIG. 2 is a plan view of the known device illustrated in FIG. 1.

In a known manner, and as shown in FIG. 1, main beams 1, 2 and cover 3 adopt, in service, definitive relative positions in which cover 3 is applied, by its opposite edges 31 and 32, on respective rabbets 11 and 22 of main beams 1 and 2, arranged parallel to one another.

Furthermore, in service, main beams 1 and 2 are buried in layer C of a covering material, such as concrete or asphalt, which extends over flanges 15 and 26 until its height hides respective upright edges 13 and 24 of main beams 1 and 2.

According to the invention, main beams 1 and 2 have respective lower webs 17 and 28 that extend below respective rabbets 11 and 22 and that are drilled with respective holes such as 171, 173, 282 and 284 (FIG. 5).

Furthermore, the equipment according to the invention, before it is put in service, adopts an installation configuration that is represented in FIGS. 3 to 6, and in which it has a bar such as 41, or two bars spaced apart from one another such as 41 and 42.

Each bar passes through respective holes, namely 171 and 282 for bar 41 (FIG. 4), and 173 and 284 for bar 42, is attached to main beams 1 and 2, and maintains these main beams and cover 3 in fixed relative positions.

Finally, as shown in FIGS. 3 and 6, this equipment has three or four level-adjustment screws, such as 51 to 54, which are screwed in respective flanges 15 and 26 of main beams 1 and 2 and which define, for the equipment in definitive configuration, a support polygon.

For example, each of bars 41 and 42 has respective ends, such as 411, 412 for bar 41, and 421, 422 for bar 42, by which this bar is attached to flanges 15 and 26 by respective attachment screws.

Bar 41 is thus attached to flanges 15 and 26 by attachment screws 61 and 62, while bar 42 is attached to flanges 15 and 26 by attachment screws 71 and 72.

Figure 4:
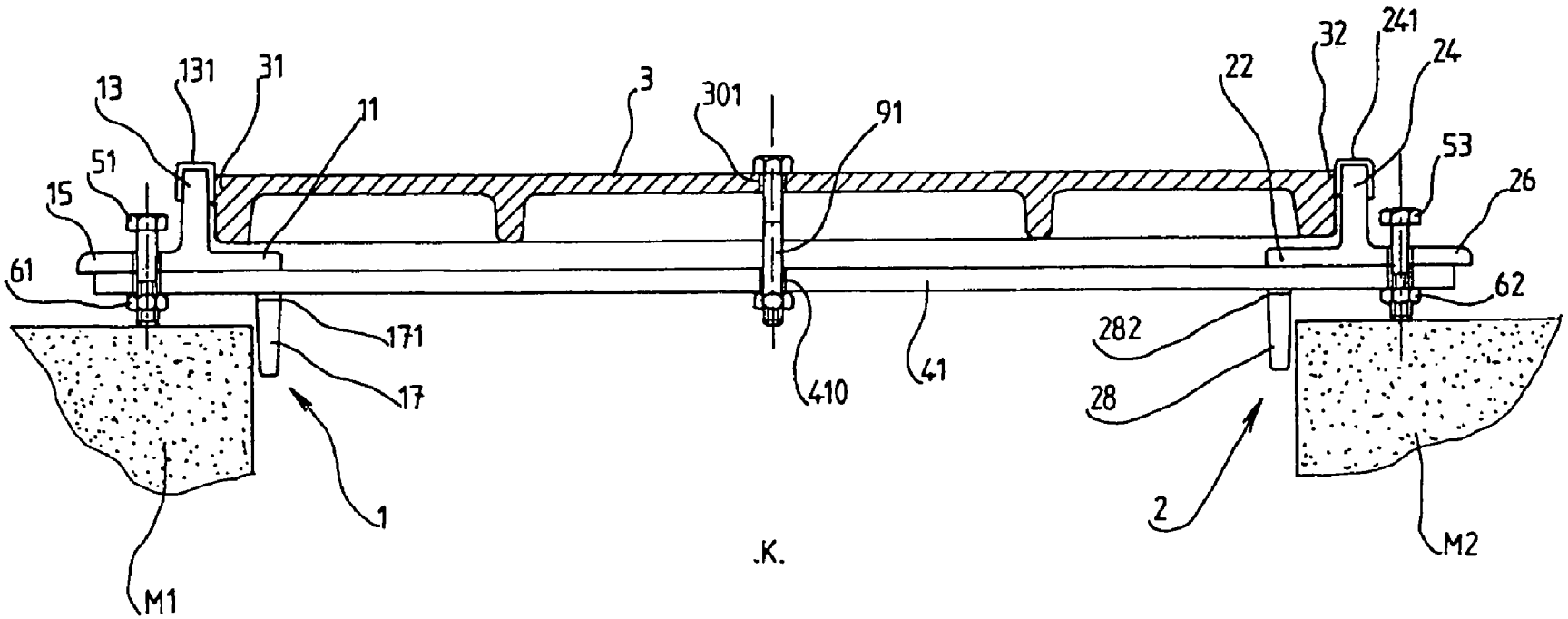
FIG. 4 is a view in vertical and transverse section of the device illustrated in FIG. 3, taken along the line defined by arrows IV—IV of FIG. 3.

In order to facilitate attachment of each bar, it can be advisable, for each main beam and as shown in FIGS. 4 to 6, to make the flange such as 15 or 26 and the rabbet such as 11 or 22 coplanar.

In practice, this equipment preferably has two pairs of level-adjustment screws per cover 3 (FIGS. 3 and 6).

Screws 51 and 52 of the first pair of adjustment screws are screwed in respective ends 151 and 152 of flange 15 of the first main beam, and screws 53 and 54 of the second pair of adjustment screws are screwed in respective ends 261 and 262 of flange 26 of the second main beam.

In order to avoid having to thread flanges 15 and 26, it can be advantageous, as shown in FIGS. 5 and 6, to provide, for each screw such as 61, 62, 71 and 72, threaded sleeve 8 that is inserted between the screw and hole 150 or 260 of the flange which receives it.

For each of bars 41 and 42 (FIG. 5), this equipment has a holding bolt, such as 91 and 92, which is engaged in an opening such as 301 and 302 of cover 3, as well as a hole such as 410 and 420 made in this bar.

In order to dampen impacts during transport, the equipment of the invention can have carriers (FIG. 3), such as 131, 132, 241 and 242, straddling the upright edge of each main beam and inserted between this main beam and cover 3.

The equipment which is described can be installed very quickly and easily over a cavity delimited between parallel walls M1 and M2 (FIG. 4), for example, over ditch K.

The installation first includes an operation which consists of putting down main beams 1 and 2 of this equipment, in installation configuration, on respective walls M1 and M2.

The distance between the walls and the width of the cover are such that in the course of this operation, lower webs 17 and 28 are inserted with slight play between walls M1 and M2.

Leveling screws 51 to 54 are then individually screwed in or out or in order to fix cover 3 at a predetermined level with respect to walls M1 and M2.

After this operation, the equipment is completely stable on walls M1 and M2 and is fixed in such a way that cover 3 is horizontal or inclined according to a desired slope, and is at the desired height.

A layer of covering material, such as concrete or asphalt, can then be deposited on both sides of main beams 1 and 2, this material covering walls M1 and M2 up to lower webs 17 and 28, which block it and prevent it from falling into cavity K.

The material thus deposited buries leveling screws 51 to 54, and covers flanges 15 and 26 of main beams 1 and 2 until its height hides upright edges 13 and 24.

After drying of the layer of covering material, it is possible to detach cover 3 from bars 41 and 42 by unscrewing screws 91 and 92, and to saw off bars 41 and 42 in the vicinity of lower webs 17 and 28 of main beams 1 and 2.

The invention claimed is:

1. An apparatus for covering a ditch comprising:

first and second main beams having respective first and second rabbets, respective first and second upright edges bordering and defining the respective rabbets, and first and second flanges bordering first and second upright edges, respectively, and transverse to the first and second upright edges;

a cover having first and second generally parallel and opposite edges, the cover being supportable at the first and second opposite edges on the first and second rabbets, respectively, of the first and second main beams when arranged parallel to one another, the first and second main beams having respective first and second lower webs that extend opposite the first and second rabbets, respectively, and include respective first and second holes;

at least a first bar for passing through the respective first and second holes to maintain the first and second main beams and the cover in fixed relative positions during placement of the cover over, and covering a ditch; and at least three level-adjustment screws engaging the first and second flanges of the first and second main beams and defining a support polygon.

2. The apparatus according to claim 1, including a second bar, spaced from the first bar, for passing through third and fourth holes in the first and second lower webs, and attachable to the first and second main beams for maintaining the first and second main beams and the cover in the fixed relative positions during placement of the cover over, and covering a ditch.

3. The apparatus according to claim 1, wherein the first and second flanges and the rabbets of each of the first and second main beams are coplanar.

4. The apparatus according to claim 1, including a first pair of level-adjustment screws engaging respective ends of the first flange, and a second pair of level-adjustment screws engaging respective ends of the second flange.

5. The apparatus according to claim 1, including a respective threaded sleeve inserted between each of the level-adjustment screws and the first and second main beams engaged by the level-adjustment screws.

6. The apparatus according to claim 2, including, for each of the first and second bars, a respective holding bolt for engaging an opening in the cover and a hole in the respective bar.

7. The apparatus according to claim 1, including carriers straddling an upright edge of each of the first and second main beams and inserted between the first and second main beams and the cover.

8. A process for the installation of the apparatus according to claim 1, over a ditch having first and second generally parallel walls, the process comprising putting down the first and second main beams on the first and second walls, the lower webs being inserted with slight play between the walls, manipulating the leveling screws to fix the cover at a level with respect to the walls, and depositing, on both sides of the first and second main beams, a layer of a covering material that covers the walls to the first and second lower webs, burying the leveling screws covering the flanges of the first and second main beams, and hiding the first and second upright edges.

9. An apparatus for covering a ditch comprising:

first and second main beams having respective first and second rabbets, respective first and second upright edges bordering and defining the respective rabbets, and first and second flanges bordering first and second upright edges, respectively, and transverse to the first and second upright edges;

a cover having first and second generally parallel and opposite edges, the cover being supportable at the first and second opposite edges on the first and second rabbets, respectively, of the first and second main beams when arranged parallel to one another, the first and second main beams having respective first and second lower webs that extend opposite the first and second rabbets, respectively, and include respective first and third holes and second and fourth holes;

a first bar for passing through the respective first and second holes to maintain the first and second main beams and the cover in fixed relative positions during placement of the cover over, and covering ditch;

a second bar, spaced from the first bar, for passing through the respective third and fourth holes, and attachable to the first and second main beams for maintaining the first and second main beams and the cover in fixed relative positions during placement of the cover over, and covering a ditch, each of the first and second bars having first and second ends for attachment to the first and second flanges with respective first and second attachment screws; and at least three level-adjustment screws engaging the first and second flanges of the first and second main beams and defining a support polygon.

10. The apparatus according to claim 9, wherein the first and second flanges and the rabbets of each of the first and second main beams are coplanar.

11. The apparatus according to claim 9, including a first pair of level-adjustment screws engaging respective ends of the first flange, and a second pair of level-adjustment screws engaging respective ends of the second flange.

12. The apparatus according to claim 9, including a respective threaded sleeve inserted between each of the attachment screws and the first and second main beams engaged by the screws.

13. The apparatus according to claim 9, including, for each of the first and second bars, a respective holding bolt for engaging an opening in the cover and a hole in the respective bar.

14. The apparatus according to claim 9, including carriers straddling an upright edge of each of the first and second main beams and inserted between the first and second main beams and the cover.

15. A process for the installation of the apparatus according to claim 9, over a ditch having first and second generally parallel walls, the process comprising:

putting down the first and second main beams on the first and second walls, the lower webs being inserted with slight play between the walls;

manipulating the leveling screws to fix the cover at a level with respect to the walls;

depositing, on both sides of the first and second main beams, a layer of a covering material that covers the walls to the first and second lower webs, burying the leveling screws, covering the flanges of the first and second main beams, and hiding the first and second upright edges; and after setting the layer of covering material, detaching the cover from each of the first and second bars and cutting and removing each of the first and second bars proximate each of the first and second lower webs.

* * * * *